US005779575A

United States Patent [19]

Hsieh

[11] Patent Number: 5,779,575

[45] Date of Patent: Jul. 14, 1998

[54] LUMIOUS GAMES SPHERICAL BODY

[76] Inventor: Frank Hsieh, 9th-1 Floor, Kuang Fu South Road, Taipei, Taiwan

[21] Appl. No.: 665,555

[22] Filed: Jun. 18, 1996

[51] Int. Cl.[6] ..... A63F 43/06

[52] U.S. Cl. ..... 473/570

[58] Field of Search ..... 273/58 G, 58 R, 273/58 A, 58 BB, 58 BA, 58 F, 58 E, 65 EF, DIG. 24; 446/242, 485; 473/570

[56] References Cited

U.S. PATENT DOCUMENTS

| | | | |
|---|---|---|---|
| 2,903,820 | 9/1959 | Bodell | 273/58 G |
| 3,304,651 | 2/1967 | Deyerl | 273/58 G |
| 3,804,411 | 4/1974 | Hendry | 273/DIG. 24 |
| 4,776,589 | 10/1988 | Yang | 273/58 G |
| 5,102,131 | 4/1992 | Remington et al. | 273/58 G |
| 5,228,686 | 7/1993 | Maleyko | 273/58 G |
| 5,236,383 | 8/1993 | Connelly | 273/58 G |
| 5,490,047 | 2/1996 | O'Rourke et al. | 273/58 G |
| 5,564,702 | 10/1996 | Meffert | 273/58 G |

*Primary Examiner*—Steven B. Wong
*Attorney, Agent, or Firm*—Browdy and Neimark

[57] ABSTRACT

A luminous spherical body is composed of a spherical inner body and an outer layer engaged over the spherical inner body. The spherical inner body is provided with a power source compartment for housing a power source switching main body and a circuit mechanism. The circuit mechanism comprises a plurality of loops radiating throughout the spherical inner body and having at least one luminous lamp. The outer layer is provided with a plurality of transparent or translucent panels corresponding in location to the luminous lamps of the spherical inner body.

10 Claims, 2 Drawing Sheets

LUMIOUS GAMES SPHERICAL BODY

FIELD OF THE INVENTION

The present invention relates generally to a game spherical body, and more particularly to a luminous game spherical body.

BACKGROUND OF THE INVENTION

The U.S. Pat. Nos. 4,776,589 and 5,236,383 disclose respectively a game spherical body provided therein with a luminous outlet capable of illuminating in the direction corresponding to the diametrical direction of the spherical body, thereby resulting in the formation of only two light sources at such time when the spherical body is rotated. In other words, there are many blind spots on the spherical body in motion. Another U.S. Pat. No. 5,228,686 discloses a luminous spherical body comprising a plurality of LED (light emitting diode) lamps which are located at the fastening area where two semispherical bodies are joined together to form the spherical body. In other words, the spherical body is provided with a limited area capable of illuminating. Moreover, such a luminous spherical body as disclosed in the U.S. Pat. No. 5,228,686 must have a solid core. The luminous spherical bodies of the prior art referred to above are rather complicated in construction and are therefore not cost-effective.

SUMMARY OF THE INVENTION

It is another objective of the present invention to provide a luminous spherical body which is simple in construction and is therefore cost-effective.

In keeping with the principle of the present invention, the foregoing objectives of the present invention are attained by a spherical body, which comprises a spherical inner body, and an outer layer engaged over the spherical inner body. The spherical inner body is provided with a power source compartment in which a power switch and a circuit are located. The circuit has a plurality of loops which are distributed in a radiate form throughout the spherical inner body and are provided respectively with a luminous lamp. The outer layer of a rubber plastic material has a plurality of transparent or translucent panels corresponding in location to the luminous lamps of the spherical inner body.

The foregoing objectives, features and functions of the present invention will be more readily understood upon a thoughtful deliberation of the following detailed description of the embodiments of the present invention in conjunction with the accompanying drawings.

DETAILED DESCRIPTION OF THE INVENTION

Figure 1:
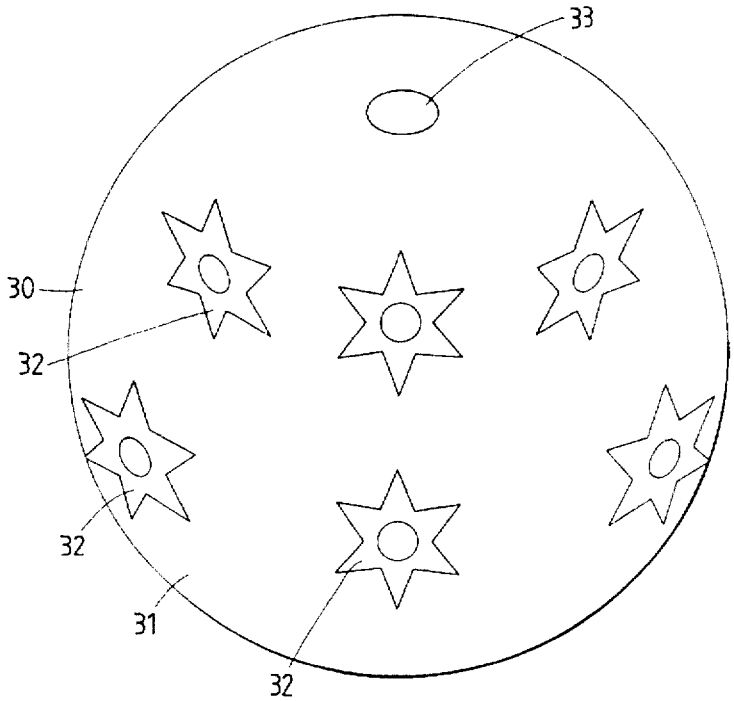
FIG. 1 shows a perspective view of a first preferred embodiment of the present invention.
Figure 2:
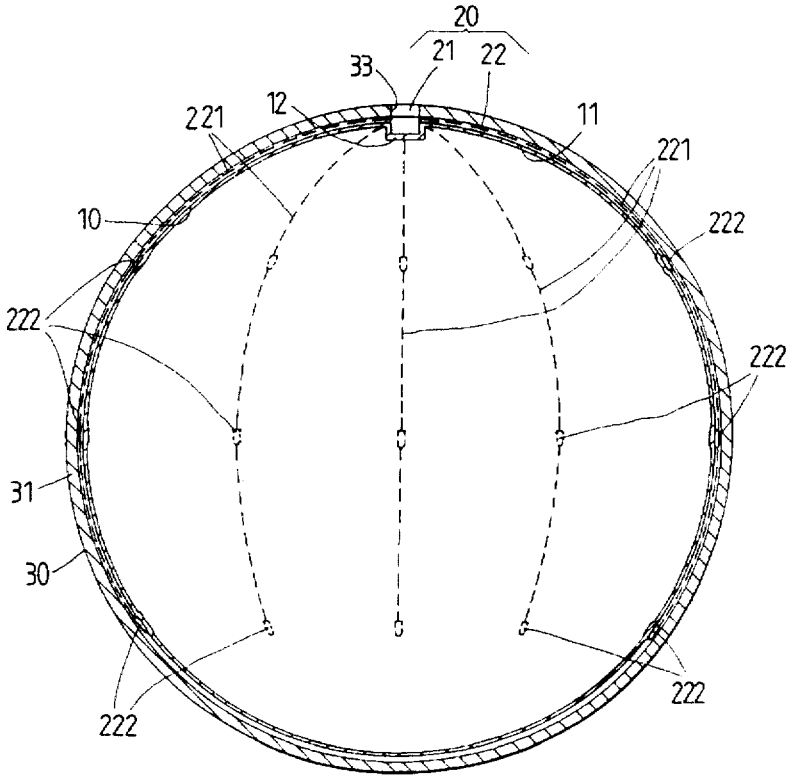
FIG. 2 shows a sectional view of the first preferred embodiment of the present invention.
Figure 3:
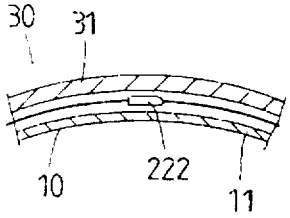
FIG. 3 shows an enlarged partial schematic view of the first preferred embodiment of the present invention.

As shown in FIGS. 1–3, a game spherical body of the first preferred embodiment of the present invention comprises the component parts which are described explicitly hereinafter.

An inner layer 10 is composed of a thin body 11 of a rubber or plastic material and capable of being inflated to have a spherical profile. The inner layer 10 is further composed of a power source compartment 12 of a U-shaped construction. The power source compartment 12 is intended to house a circuit unit 20 which is composed of a power source switching main body 21 and a circuit mechanism 22. The power source switching main body 21 has dual functions of serving as a power source and a switching device. The circuit mechanism 22 is attached to the thin body 11 and is composed of a plurality of loops 221 which are arranged in a radiate manner. Each of the loops 221 is provided with a plurality of LED (light emitting diode) lamps 222.

An outer layer 30 is composed of a thin body 31 of a rubber or plastic material and capable of being inflated to become spherical in shape. The thin body 31 is engaged to the outer surface of the inner layer 10 and is provided with a plurality of recesses closed by transparent or translucent panels or luminous outlets 35 corresponding in location to the LED lamps 222 of the inner layer 10. The thin body 31 of the outer layer 30 is marked with a plurality of patterns 32 corresponding in location to the LED lamps 222 for enhancing the aesthetic effect of the spherical body. The outer layer 30 is provided with an opening 33 corresponding in location to the power source switching main body 21 for providing an easy access to the switching device and for replacing the old batteries.

It is suggested that the outer layer 30 is slightly more rigid than the inner layer 10 so as to prolong the longevity of the spherical body. In addition, the circuit mechanism 22 may be provided with an oscillation (circuit 223) to bring about a glaring effect of the lamps 222 at such time when the spherical body is in motion. Further, the addition of the oscillation circuit 223 can cause the LED lamps 222 to be turned off automatically at such time when the spherical body remains in a static state.

Figure 4:
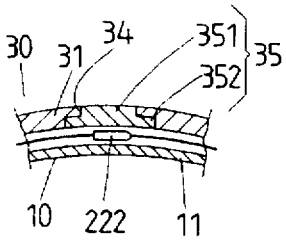
FIG. 4 shows an enlarged partial schematic view of a second preferred embodiment of the present invention.

As shown in FIG. 4, a spherical body of the present invention comprises an opaque outer layer 30, which is provided with a plurality of recesses 34 corresponding in location to the LED lamps 222 closed by transparent or translucent panels or luminous outlets 35 permeable to light emitted by the LED lamps 222. The panels or luminous outlets 35 are made of a rubber or plastic material and is composed of a top portion 351 and a bottom portion 352. The top portion 351 is equal in the cross-sectional area to the recesses 34 and are sealed off by top portion 351. The bottom portion 352 is greater in the cross-sectional area than the bottom of recesses 34 so as to enable the piece 35 to be located securely in the recess 34.

Figure 5:
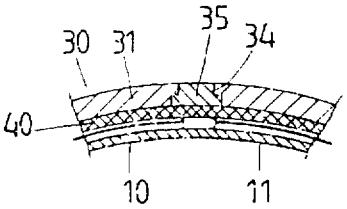
FIG. 5 shows an enlarged partial schematic view of a third preferred embodiment of the present invention.

As shown in FIG. 5, a spherical body of the present invention comprises an inner layer 10 which is tightly wound with a yarn 40 before the inner layer 10 is covered with the outer layer 30.

Figure 6:
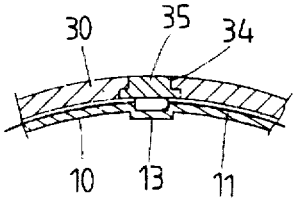
FIG. 6 shows an enlarged partial schematic view of a fourth preferred embodiment of the present invention.

As shown in FIG. 6, a modified spherical body of the present invention comprises an inner layer 10 which is provided with a plurality of lamp cavities 13 for accommodating the LED lamps 222 such that the LED lamps 222 are less vulnerable to breakage at such time when the spherical body is bounced on the floor or ground.

Figure 7:
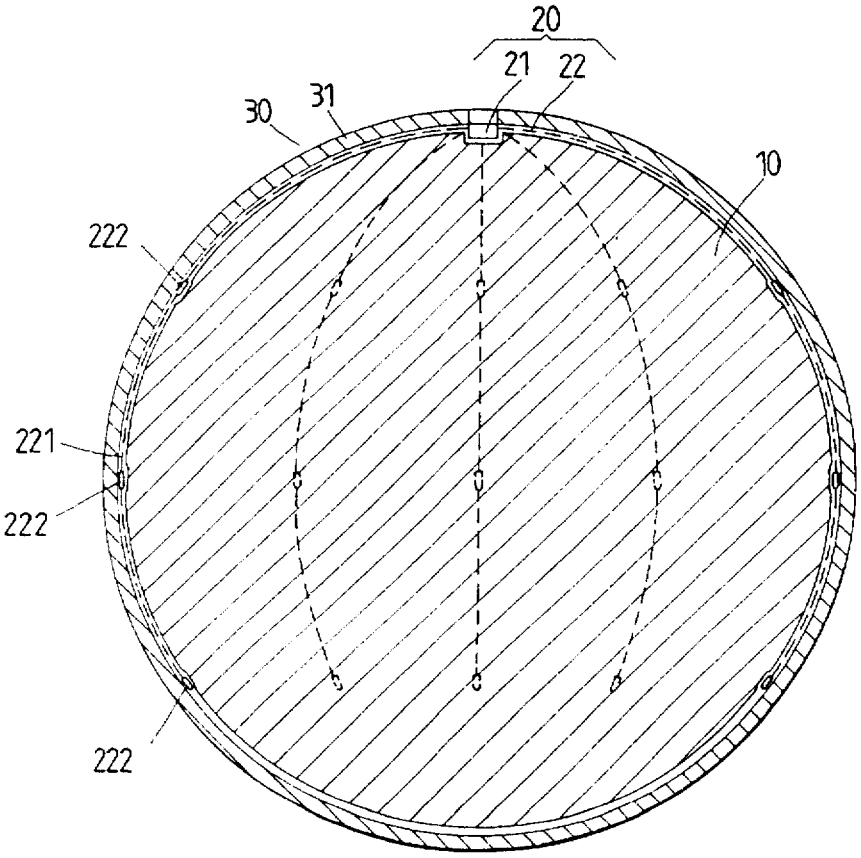
FIG. 7 shows an enlarged partial schematic view of a fifth preferred embodiment of the present invention.

The spherical body of the present invention may be further modified such that the inner layer 10 is made of a solid elastomer of a rubber, plastic or foam material, as illustrated in FIG. 7.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A luminous spherical body comprising:

a spherical inner body having a power source compartment for housing a power source switching main body and a circuit mechanism having a plurality of loops arranged in a radiate manner such that each of said loops is provided with at least one luminous lamp; and an outer layer of a rubber or plastic material engaged over said spherical body, said outer layer provided with a plurality of transparent or translucent panels, said plurality of transparent or translucent panels respectively corresponding in location to each said luminous lamp of said spherical inner body, said outer layer further provided with an opening corresponding in location to said power source switching main body.

2. The luminous spherical body as defined in claim 1, wherein said outer layer is provided with a plurality of recesses respectively corresponding in location to each said luminous lamp, each of said plurality of recesses being closed by one of said plurality of transparent or translucent panels, each of said plurality of translucent or transparent panels being a rubber or plastic element permeable to light.

3. The luminous spherical body as defined in claim 1, wherein said spherical inner body is inflatable so as to become a spherical body having a hollow interior.

4. The luminous spherical body as defined in claim 1, wherein said spherical inner body is made of a solid elastomer.

5. The luminous spherical body as defined in claim 1, wherein said circuit mechanism comprises an oscillation circuit.

6. The luminous spherical body as defined in claim 1, wherein said spherical inner body and said outer layer are provided therebetween a yarn which is wound tightly on said spherical inner body.

7. The luminous spherical body as defined in claim 1, wherein said spherical inner body is provided with a plurality of lamp cavities for respectively accommodating each said luminous lamp.

8. The luminous spherical body as defined in claim 1, wherein said outer layer is marked with a plurality of patterns corresponding respectively in location to each said luminous lamp.

9. The luminous spherical body as defined in claim 2, wherein each said rubber or plastic element has a top portion and a bottom portion, with said top portion being equal in a cross-sectional area to each of said recesses, and with said bottom portion being greater in a cross-sectional area than each of said recesses.

10. The luminous spherical body as defined in claim 1, wherein said luminous lamp is a light emitting diode (LED) lamp.

* * * * *